United States Patent [19]

Soes

[11] 4,066,327

[45] Jan. 3, 1978

[54] ELECTRICAL CONNECTOR ASSEMBLIES

[75] Inventor: Lucas Soes, Vught, Netherlands

[73] Assignee: AMP Incorporated, Harrisburg, Pa.

[21] Appl. No.: 763,731

[22] Filed: Jan. 28, 1977

[30] Foreign Application Priority Data

Feb. 21, 1976 United Kingdom ..... 06913/76

[51] Int. Cl.[2] ..... H01R 13/06

[52] U.S. Cl. ..... 339/252 R; 339/258 R

[58] Field of Search ..... 339/97 R, 97 P, 99 R, 339/176 R, 176 M, 176 MF, 176 MP, 217 R, 252 R, 258 R, 258 C, 258 F, 258 P

[56] References Cited

U.S. PATENT DOCUMENTS

| | | | |
|---|---|---|---|
| 3,732,531 | 5/1973 | Bouley | 339/258 R |
| 3,827,005 | 7/1974 | Friend | 339/258 P |
| 3,960,434 | 6/1976 | Soes | 339/258 P |

*Primary Examiner*—Joseph H. McGlynn
*Attorney, Agent, or Firm*—Allan B. Osborne

[57] ABSTRACT

An electrical connector assembly includes a forked female contact having first and second spaced cantilever contact arms extending from a yoke portion which arms receive between them a mating male contact having a contact arm extending from a base. One of the contact arms of the female contact is stiffer than the other contact arm and from this stiff contact arm there extends a member for anchoring the female contact to a printed circuit board or the like. When the male contact enters the female contact outward flexure of the less stiff contact arm of the female contact takes place concomitantly with inward flexure of a portion of the contact arm of the male contact which engages the relatively stiff contact arm of the female contact.

5 Claims, 4 Drawing Figures

ELECTRICAL CONNECTOR ASSEMBLIES

The present invention relates to electrical connector assemblies and especially to electrical connector assemblies for use in the electronics industry.

According to the present invention, an electrical connector assembly comprises a forked female contact having first and second spaced contact arms extending from a yoke portion and receiving a mating male contact, the second contact arm being stiff relative to the first contact arm and having a member extending outwardly from it, the male contact having a base and a resilient contact arm having a first portion extending forwardly from the base to a first junction, a second portion extending from the first junction at substantially 90° to the first portion to a second junction and a third portion extending from the second junction generally rearwardly, the male contact entering the female contact by outward flexure of the first contact arm of the female contact and inward flexure of the third portion of the contact arm of the male contact.

Embodiments of the invention will now be described, by way of example, reference being made to the figures of the accompanying diagrammatic drawings in which.

Figure 1:
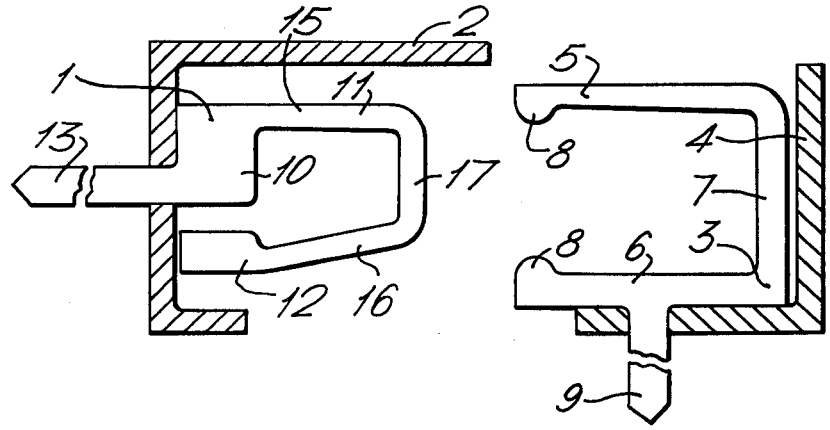
FIG. 1 is a side elevation partly in cross-section of two electrical connectors which when mated form an electrical connector assembly.
Figure 2:
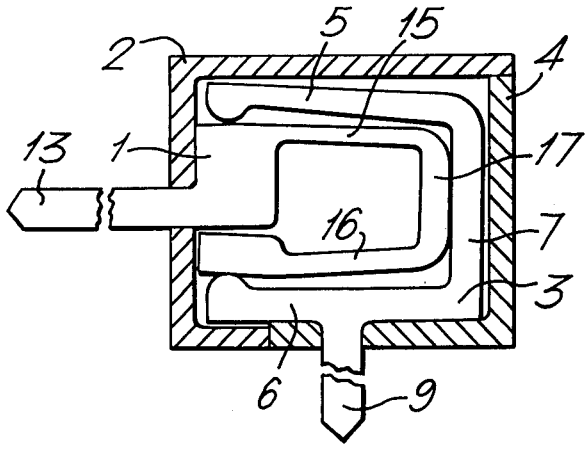
FIG. 2 is a side elevation partly in cross-section of the electrical connectors of FIG. 1 in mating engagement to form an electrical connector assembly.

Referring to FIGS. 1 and 2, an electrical connector assembly includes at least one male electrical contact 1 mounted in a housing 2 and engaging at least one female electrical contact 3 mounted in a housing 4.

The female contact 3 is stamped and formed from sheet material and comprises first and second spaced contact arms 5 and 6 extending from a yoke portion 7. At its free end each contact arm 5, 6 has inwardly directed lobes 8. The first contact arm 5 tapers from a relatively thick part adjacent the yoke portion 7 to a relatively thin part adjacent the lobe 8. In contrast, the contact arm 6 has the same thickness throughout its length which thickness is thicker than the thickest part of the contact arm 5. As a consequence, the second contact arm 6 is stiff relative to the first contact arm 5. A member in the form of a post 9 extends outwardly from the contact arm 6. The female contact 3 is anchored in the housing 4 by means of the post 9 which extends through a wall of the housing and outwardly from the housing.

The male contact 1 is stamped and formed from sheet material and has a base 10 and a resilient contact arm 11. The contact arm 11 has a first portion 15 extending forwardly from the base 10 to a first junction, a second portion 17 extending from the first junction at substantially 90° to the first portion 15 to a second junction and a third portion 16 extending from the second junction generally rearwardly. A member in the form of a post 13 extends rearwardly from the base 10. At the free end of the third portion 16 an abutment 12 is provided in general alignment with the base 10. The male contact 1 is anchored in the housing 2 by means of the post 13 which extends through a wall of the housing 2.

On mating, the male contact 1 enters between the contact arm 5, 6 of the female contact 3. Since the contact arm 5 is relatively resilient it will flex outwardly and since the third portion 16 of the contact arm 11 is also resilient relative to the contact arm 6 it will flex inwardly. At maximum flexure the abutment 12 will just touch the base 10 which in effect inhibits any tendency to overstressing of the contact arm 11. When the contacts 1, 3 are fully mated then the housings 2, 4 will be in contact and, in effect, define a complete enclosure for the contacts 1, 3. The posts 9, 13 can be mounted on printed circuit boards so that the contacts 1, 3 effectively interconnect conductive paths on separate printed circuit boards.

Figure 3:
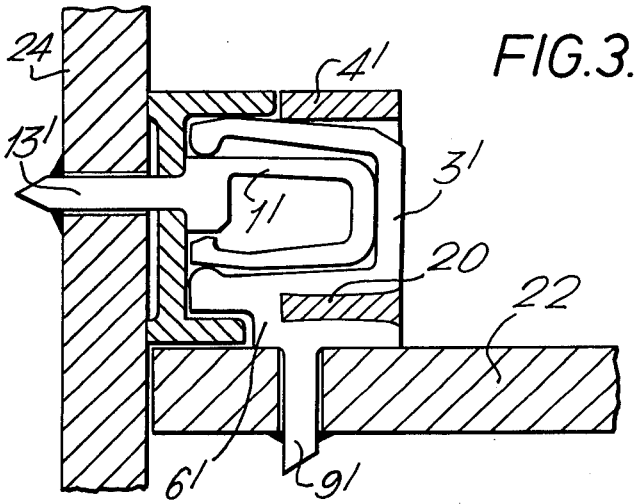
FIG. 3 is a side elevation partly in cross-section of a modified electrical connector assembly.

The electrical connector assembly described above can be modified as illustrated in FIG. 3 where the female contact 3' has a contact arm 6' which is bifurcated to extend along opposite surfaces of a side wall 20 of a housing 4' to anchor the contact 3' in the housing 4'. A member in the form of a post 9' extends from the contact arm 6' and is shown extending through an aperture of a printed circuit board 32.

The male contact 1' has a member in the form of a post 13' which extends through a printed circuit board 24.

When the contacts 1', 3' are mated they interconnect conductive paths (not shown) on the printed circuit boards 22, 24 which are arranged at 90° to each other.

Figure 4:
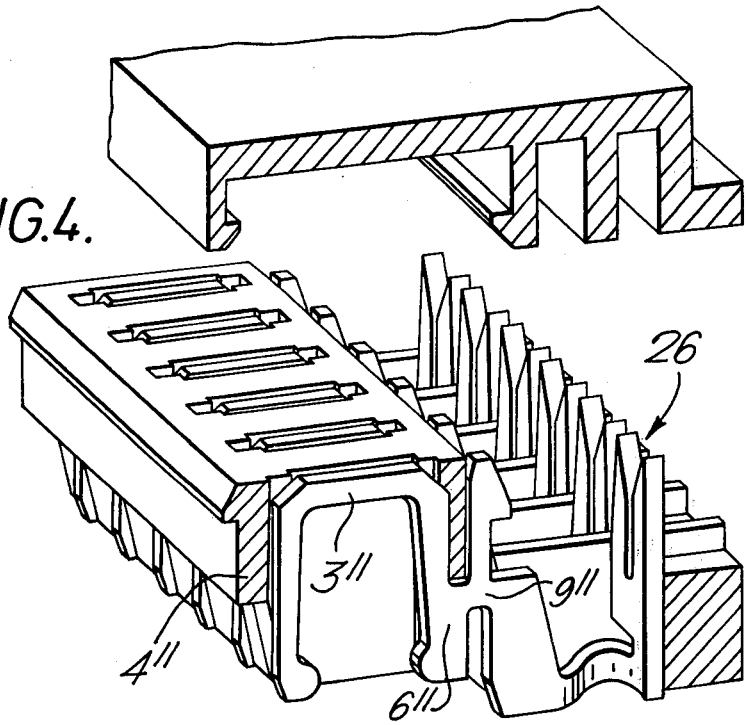
FIG. 4 is a perspective view, partly in cross-section, of a modified electrical connector.

FIG. 4 shows a female contact 3'' mounted in a housing 4'' and having a member 9'' extending from a relatively stiff contact arm 6'', which member 9'' forms part of a wire receiving structure 26.

What is claimed is:

1. An electrical connector assembly comprising a forked female contact having first and second spaced cantilever contact arms extending from a yoke portion and receiving a mating male contact, the second contact arm being stiff relative to the first contact arm and having a member extending outwardly from it, the male contact having a base and a resilient contact arm having a first portion extending forwardly from the base to a first junction, a second portion extending from the first junction at substantially 90° to the first portion to a second junction and a third portion extending from the second junction generally rearwardly, the male contact entering the female contact by outward flexure of the first contact arm of the female contact and inward flexure of the third portion of the contact arm of the male contact.

2. An electrical connector assembly as claimed in claim 1, in which the member is in the form of a post extending outwardly from the second relatively stiff contact arm through a wall of a housing in which housing the female contact is mounted.

3. An electrical connector assembly as claimed in claim 1, in which the second relatively stiff contact arm of the female contact is bifurcated and extends along opposite surfaces of a side wall of a housing, in which housing the female contact is mounted, the member being in the form of a post extending outwardly from the second relatively stiff contact arm.

4. An electrical connector assembly as claimed in claim 1, in which a post extends rearwardly from the base of the male contact through a wall of a housing in which housing the male contact is mounted.

5. An electrical connector assembly as claimed in claim 1, in which the member is in the form of a wire receiving structure.

* * * * *